US005904250A

United States Patent [19]

De Schutter

[11] Patent Number: 5,904,250

[45] Date of Patent: May 18, 1999

[54] BOUND SET THEREFOR OF DISPOSABLE CUTLERY

[75] Inventor: Jef De Schutter, Brecht, Belgium

[73] Assignee: De Ster N.V., Hoogstraten, Belgium

[21] Appl. No.: 08/637,624

[22] PCT Filed: Sep. 2, 1994

[86] PCT No.: PCT/EP94/02913

§ 371 Date: Aug. 21, 1996

§ 102(e) Date: Aug. 21, 1996

[87] PCT Pub. No.: WO95/11609

PCT Pub. Date: May 4, 1995

[30] Foreign Application Priority Data

Oct. 29, 1993 [DE] Germany ..... 93 16 566 U

[51] Int. Cl.[6] ..... B65D 85/20

[52] U.S. Cl. ..... 206/553; 30/142

[58] Field of Search ..... 30/142, 147–150, 30/340; 7/901; 206/442, 553

[56] References Cited

U.S. PATENT DOCUMENTS

| | | | |
|---|---|---|---|
| D. 166,100 | 3/1952 | Roop | 30/147 |
| 202,757 | 4/1878 | Reese | 30/147 |
| 2,185,942 | 1/1940 | Frank | 30/147 |
| 4,317,284 | 3/1982 | Prindle | 30/147 |
| 4,524,512 | 6/1985 | Formo et al. | 30/150 |
| 4,995,154 | 2/1991 | Bamber | 30/147 |

FOREIGN PATENT DOCUMENTS

| | | |
|---|---|---|
| 0129495 | 12/1984 | European Pat. Off. . |
| 1178122 | 5/1959 | France . |
| 801108 | 12/1950 | Germany . |
| 38218 | 2/1960 | Luxembourg . |
| 22788 | 9/1915 | United Kingdom . |

*Primary Examiner*—Jim Foster
*Attorney, Agent, or Firm*—Shlesinger, Arkwright & Garvey LLP

[57] ABSTRACT

The invention relates to a bundle (40) of disposable cutlery implements (6) (knives, forks or spoons). The bundle (40) consists of a stable stack of nesting implements (6) secured together by a strip or band (42). The implements have a handle (8) and an operative part (10) (blade, tines or bowl). The handle (8) of each implement (6) has a roughly U-shaped cross section over its entire length. The two arms (14) and (16) of the U-section form a blunt angle with the web (18). At the end of the handle both arms are joined together also to form a blunt angle with the wall section (20) formed by the web. In order to be able to form large stable stacks of nesting implements of the same kind while reducing the volume of packaging material required, the two arms (14) and (16) of the handles (8) are extended beyond the transition (22) to the operative part (10) and gradually taper to merge with the edge thereof.

12 Claims, 5 Drawing Sheets

BOUND SET THEREFOR OF DISPOSABLE CUTLERY

FIELD OF THE INVENTION

The invention concerns a bound set of disposable cutlery composed of such items as spoons, forks or knives.

BACKGROUND OF THE INVENTION

The European patent document 129,495 A to Formo et al. discloses nesting, stackable cutlery in particular so designed that one spoon, one fork and one knife can nest into one bound set. Moreover cutlery of only one kind, for instance spoons, also are meant to be nesting into one stack. However the cutlery items being designed to assure reliable stacking in the sequence of spoon, fork and knife from bottom to top, with special emphasis on the mutual matching of the cutlery items whereby the knife and the fork shall not protrude and are unable to pierce the packaging, cutlery items of the same kind are less suited to making large and stable stacks. To avert the danger of stack destruction in large packagings requires comparatively much packing material such as cardboard layers or pouches. Removing small quantities from the stack entails much effort or additional packaging material.

A bound set of cutlery composed of three different cutlery items (knife, fork, spoon) is known from the British patent document 2,177,894 A wherein for instance the knife handle is fitted at its top and lower sides with a series of shapes in the form of knurls or nodes in the longitudinal direction of the handle. Said shapes enter recesses present in the handles of the spoon and fork and complementary with the knife shapes, whereby the cutlery composed of spoon, fork and knife can be fitted into each together. Stable stacking of identical cutlery items is not provided in this known cutlery, furthermore it is precluded per se.

The German patent document 801108 C discloses cutlery composed of spoon, fork and knife wherein the cutlery items evince flat handles and are designed to be placed one on the other, elevations formed on the handle of one cutlery item entering recesses in the cutlery item on top of it. Placed on top of each other, the three cutlery items can be bound together by a resilient sleeve. Stable stacking of identical cutlery items is not provided for this cutlery nor is it feasible.

OBJECT AND SUMMARY OF THE INVENTION

The object of the present invention is the creation of a bound set of disposable cutlery items allowing one to lower the stack volume and reduce the packaging material, especially of large packages, while at the same time achieving in a simple manner stable stacking and easy removal of partial quantities also from large packages.

This object is solved by the provision of a bound set of items (spoons, forks, or knives) of disposable cutlery, including a stable stack of several mutually nesting cutlery items, and which stack is held together by a clamp or a binder.

Advantageous and appropriate further developments of the solution of the invention are described below.

The present invention allows stable stacking and consolidation of a large number of identical cutlery items into large bound sets. A mere banderole or tape suffices to hold together a stack. Accordingly the cutlery items formed into bound sets of the invention are remarkably well suited for high-volume users and dispensers.

The invention is elucidated below in relation to the attached drawing showing illustrative embodiments.

BRIEF DESCRIPTION OF THE DRAWINGS

Identical elements of the cutlery items of the Figures of the drawing are denoted by the same reference numerals.

DETAILED DESCRIPTION OF THE INVENTION

Figure 1:
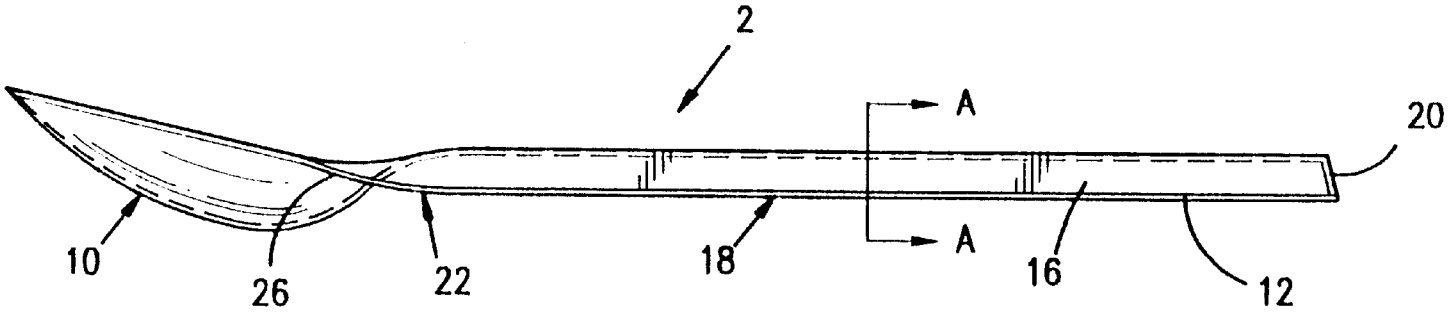
FIGS. 1, 2 show a spoon in side and in top views, respectively.
Figure 2:
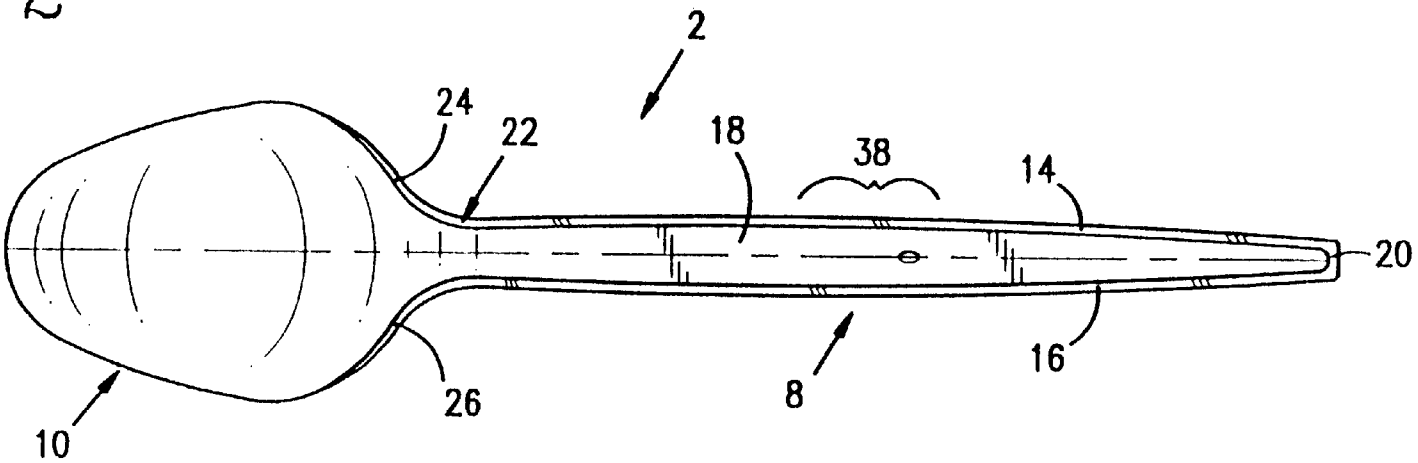

The drawing shows cutlery items, namely a spoon 2, a knife 4 and a fork 6 each constituted of a handle 8 and an operational part 10.

Cross-sectionally and over its full length, the handle 8 assumes a U-contour 12 of which the two legs 14 and 16 subtend obtuse angles with its web or top wall portion 18. A wall part 20 also joining the web at obtuse angles connects the two legs.

The legs 14 and 16 extend 24, 26 through the transition zones 22 to the operative portion 10 and, tracking the shape of the operative portion, gradually taper and merge into the edge of the operative portion in such manner that the cutlery items of the same kind when stacked (FIG. 8) not only overlap in the handle zone but also in the zone of the leg extensions 24 and 26 and thereby produce high stacking stability.

Moreover the particular cutlery items are provided with inherently enhanced stability by the leg extensions.

Spoon 2 has a bowl as its operational portion 10. The forwardmost portion of such bowl extends above a plane containing top wall portion or web 18.

Figure 4:
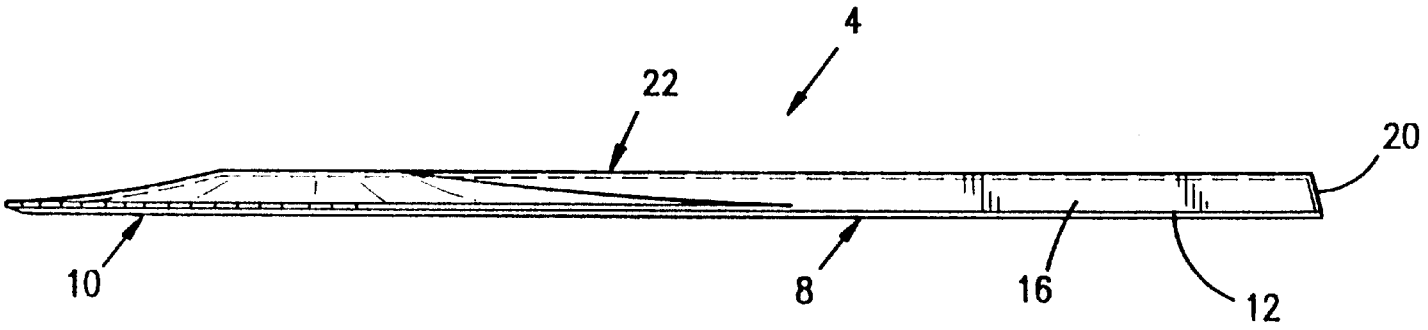
FIGS. 3, 4 show a knife in side and in top views, respectively.
Figure 3:
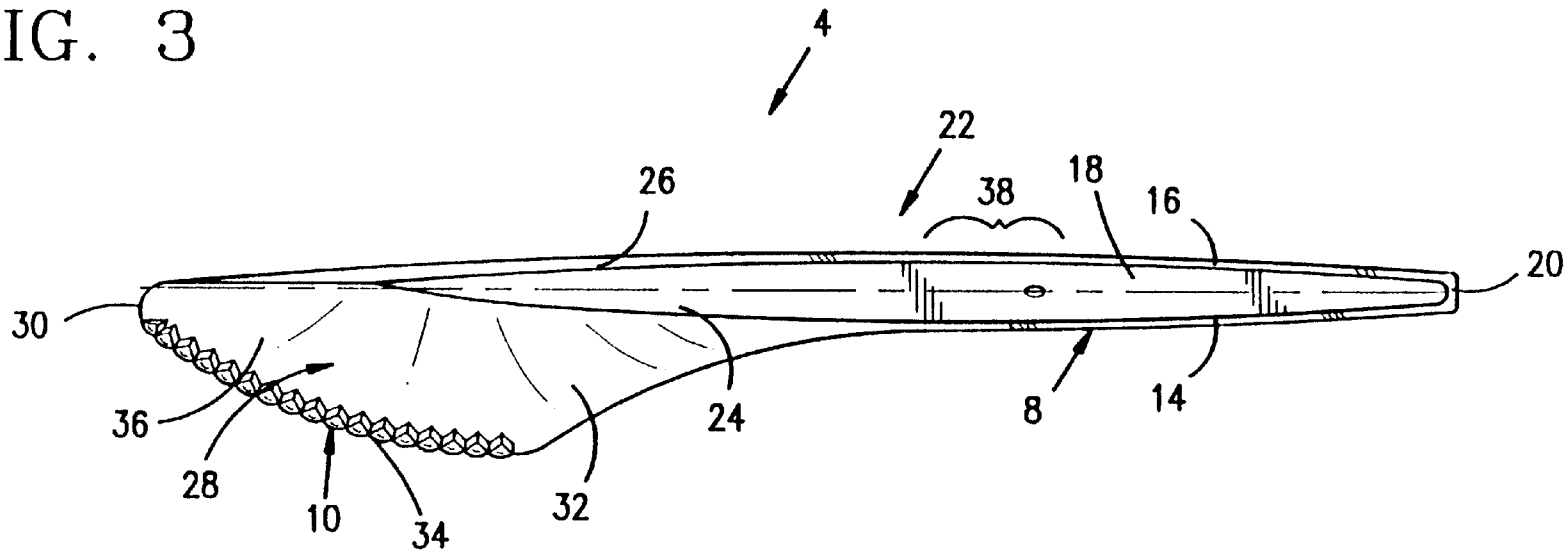

As regards the knife shown in FIGS. 3 and 4, the extension 24 of the leg 14 away from the blade 28 is formed as a knife back as a result of which the knife is endowed with special strength in the zone of the blade. The tapering extension 26 ends at the knife tip 30.

The blade 28 consists of a portion 32 integrated into the cutting-side leg 14 and gradually merging in the direction of the knife tip 30 into the web 18 of the handle's U-contour 12 and of a portion 36 fitted with teeth 34 joining said portion 32 through a slight curvature.

The web 18 sharply tapers in the toothed blade portion 36 at the end 16 away from the blade.

The handles of the cutlery items spoons, knives, forks are somewhat wider in the middle zone 38 than in the end zones. The handle may include a roughened surface.

Figure 5:
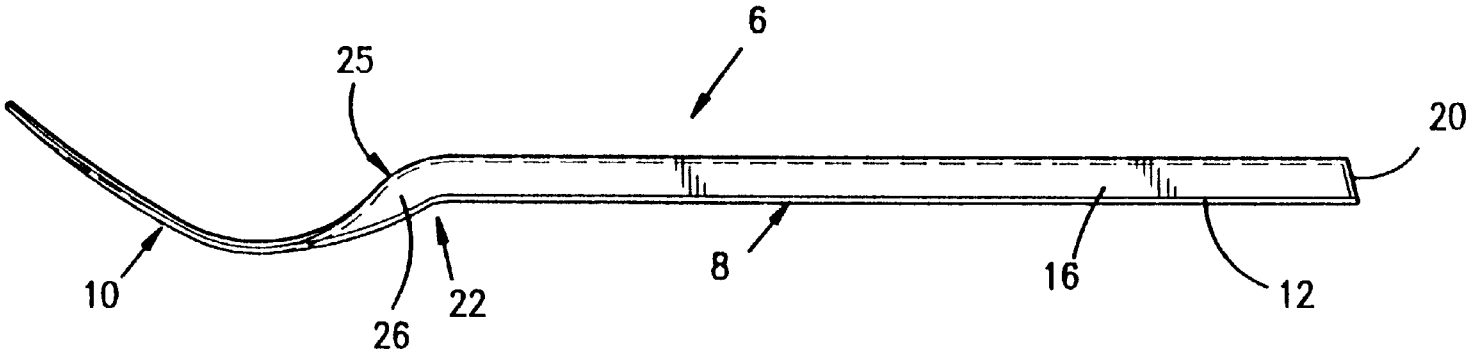
FIGS. 5, 6 show a fork in side and in top views, respectively
Figure 6:
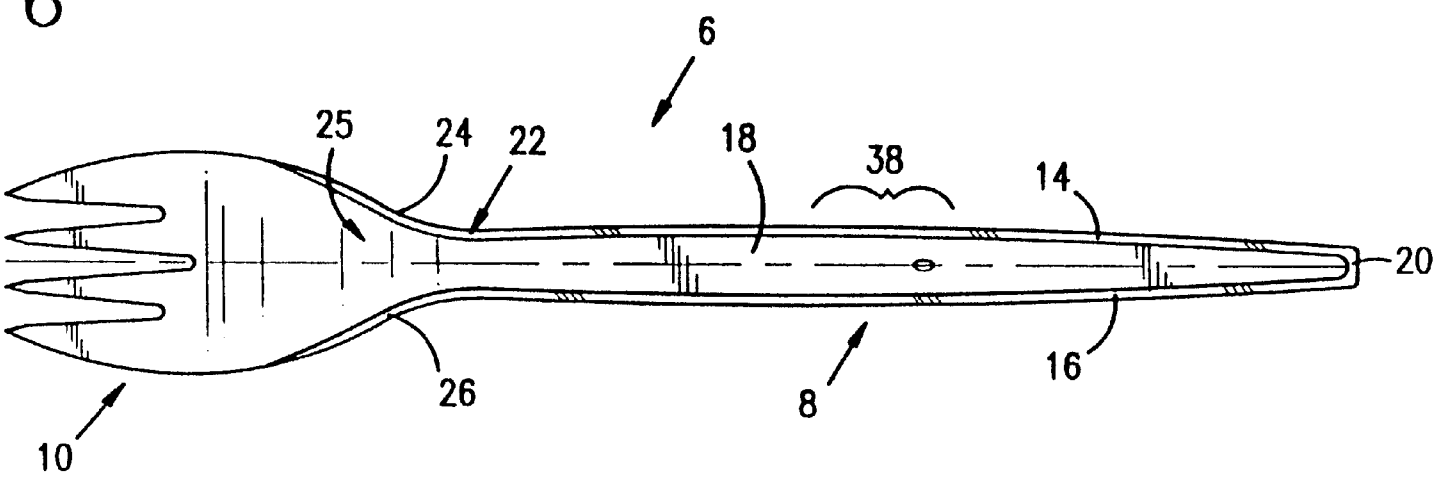
Figure 7:
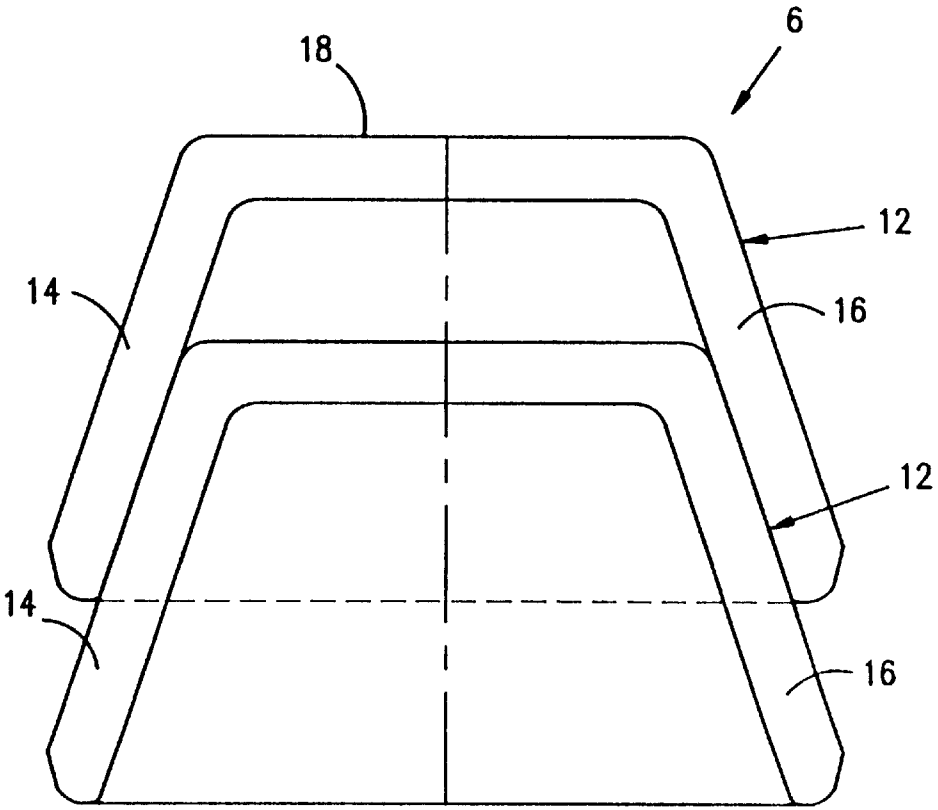
FIG. 7 is a section taken along line A—A through the handles of the spoon, knife and fork of FIGS. 1 through 6.
Figure 8:
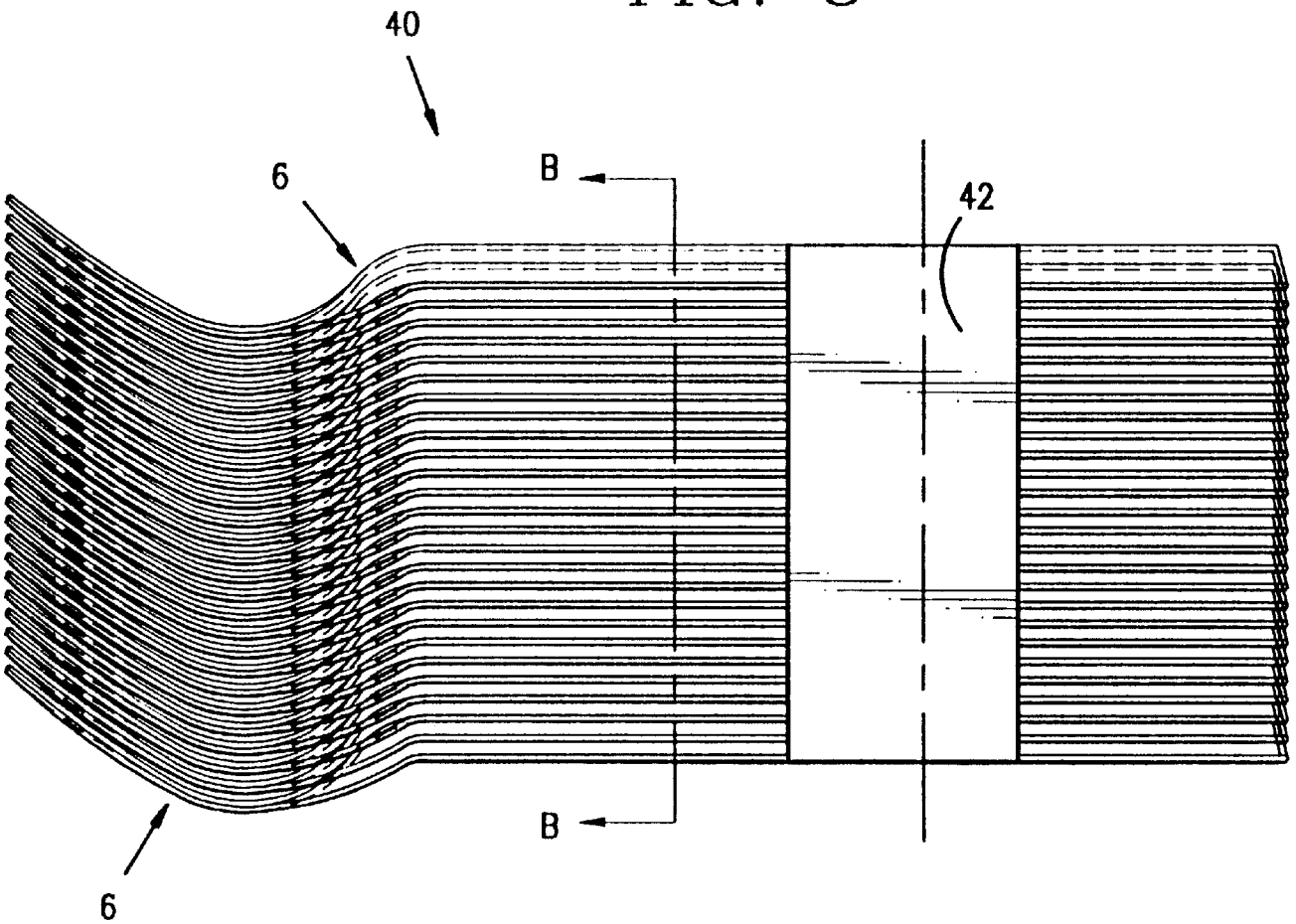
FIG. 8 shows several forks stacked into a bound set.

Operational portion 10 of forks 6 may include four (4) tines, as shown. The forwardmost tips of such tines extend above a plane containing top wall portion or web 18, as shown in FIGS. 5 and 8. There is an extended portion 25 of top wall portion 18 that extends through transition zone 22 and this extended portion 25 is disposed between the extended portions 24 and 26 of legs 14 and 16.

Figure 9:
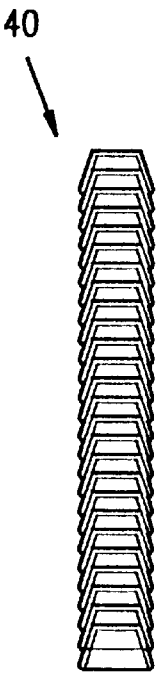
FIG. 9 is a section taken along line B—B of the stack of forks of FIG. 8.

As illustratively shown for forks in FIGS. 8 and 9, similar cutlery items may be nested, stacked and held together into substantial, stable bound sets 40. A stacked bound set may be kept stably held together merely by a strap (banderole) 42 or a tape.

The bound sets of the invention are compact and already will be stable using simple binding means, whereby complex packaging can be eliminated and furthermore use in automated dispensers is facilitated.

I claim:

1. A stack of stackable knives, each one of said stackable knives comprising:

a) a handle having a front end and a spaced apart rear end;

b) said handle including a substantially U-shaped cross section over substantially the entire length thereof;

c) said U-shaped cross section including a left leg, a spaced apart right leg, and a top wall portion joining said left leg to said right leg;

d) a knife blade disposed at said front end of said handle;

e) a transition zone disposed between and connecting said knife blade to said handle;

f) said knife blade including a cutting edge disposed on the left side thereof, a knife back disposed on the right side thereof, and a tip at the front thereof;

g) an extended portion of said right leg extending through and past said transition zone and defining said knife back, and said knife back tapering leftwardly and terminating substantially at said tip of said knife blade for enhancing stacking stability in said transition zone, for enhancing stacking stability of said knife blade, and for enhancing the strength of said knife blade;

h) an extended portion of said left leg extending through and past said transition zone into said knife blade for enhancing the strength and stackability of said knife blade and said transition zone; and, i) an extended portion of said top wall portion extending through and past said transition zone into said knife blade for enhancing the strength and stackability of said transition zone and said knife blade.

2. A stack of stackable knives as defined in claim 1, wherein:

a) a clamping member is placed around the handles of the stack of stackable knives.

3. A stack of stackable knives as defined in claim 2, wherein:

a) said clamping member is selected from the group consisting of a banderole, a string, a rubber band, a wire, a clamp, and a clip.

4. A stack of stackable knives as defined in claim 1, wherein:

a) a wall part is disposed at said rear end of said handle, and said wall part joins said left leg, said right leg, and said top wall portion.

5. A stack of stackable knives as defined in claim 4, wherein:

a) said wall part extends outwardly downwardly away from said top wall portion and defines an obtuse angle with said top wall portion.

6. A stack of stackable knives as defined in claim 1, wherein:

a) said handle includes a roughened surface.

7. A stack of stackable spoons, each one of said stackable spoons comprising:

a) a handle having a front end and a spaced apart rear end;

b) said handle including a substantially U-shaped cross section over substantially the entire length thereof;

c) said U-shaped cross section including a left leg, a spaced apart right leg, and a top wall portion joining said left leg to said right leg;

d) a bowl disposed at said front end of said handle;

e) a transition zone disposed between and connecting said bowl to said handle;

f) an extended portion of said right leg extending through and past said transition zone and defining an upper edge of said bowl, and said upper edge tapering upwardly for enhancing stacking stability in said transition zone, for enhancing stacking stability of said bowl, and for enhancing the strength of said bowl;

g) an extended portion of said left leg extending through and past said transition zone and defining an upper edge of said bowl, and said upper edge tapering upwardly for enhancing stacking stability in said transition zone, for enhancing stacking stability of said bowl, and for enhancing the strength of said bowl; and, h) a forwardmost portion of said bowl extending upwardly and being disposed above a plane containing said top wall portion for enhancing the stackability of said bowl and for increasing the volume of said bowl.

8. A stack of stackable spoons as defined in claim 7, wherein:

a) a clamping member is placed around the handles of the stack of stackable spoons.

9. A stack of stackable spoons as defined in claim 8, wherein:

a) said clamping member is selected from the group consisting of a banderole, a string, a rubber band, a wire, a clamp, and a clip.

10. A stack of stackable spoons as defined in claim 7, wherein:

a) a wall part is disposed at said rear end of said handle, and said wall part joins said left leg, said right leg, and said top wall portion.

11. A stack of stackable spoons as defined in claim 10, wherein:

a) said wall part extends outwardly downwardly away from said top wall portion and defines an obtuse angle with said top wall portion.

12. A stack of stackable spoons as defined in claim 7, wherein:

a) said handle includes a roughened surface.

* * * * *